US006426764B2

(12) United States Patent
Shiida et al.

(10) Patent No.: US 6,426,764 B2
(45) **Date of Patent: *Jul. 30, 2002**

(54) HEAD LOADING DEVICE

(75) Inventors: Sakae Shiida, Numazu; Tadao Kamano; Yoshihide Akuzawa, both of Shizuoka-ken; Hitoshi Ushiogi, Mishima, all of (JP)

(73) Assignee: Toshiba Tec Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,462

(22) Filed: Mar. 24, 1999

(30) Foreign Application Priority Data

Mar. 27, 1998 (JP) ..... 10-081226

(51) Int. Cl.[7] ..... B41J 25/308; B41J 2/01
(52) U.S. Cl. ..... 347/8; 347/104
(58) Field of Search ..... 347/8, 49, 104, 347/37, 29

(56) References Cited

U.S. PATENT DOCUMENTS

| | | | | | |
|---|---|---|---|---|---|
| 5,178,476 | A | * | 1/1993 | Lindelow | 400/352 |
| 6,070,977 | A | * | 1/2000 | Nuita et al. | 347/104 |
| 6,074,056 | A | * | 1/2000 | Kubo et al. | 347/104 |
| 6,050,664 | A | * | 4/2000 | Wilson, II | 347/8 |
| 6,050,683 | A | * | 4/2000 | Nuita et al. | 347/104 |
| 6,126,267 | A | * | 10/2000 | Ito et al. | 347/35 |
| 6,149,262 | A | | 11/2000 | Shiida et al. | 347/37 |

FOREIGN PATENT DOCUMENTS

| | | | |
|---|---|---|---|
| EP | 0 441 425 | A | 8/1991 |
| EP | 0 539 838 | A2 | 5/1993 |
| EP | 0 764 543 | A | 3/1997 |
| EP | 0 893 263 | A2 | 1/1999 |
| GB | 2 050 252 | A | 1/1981 |
| GB | 2 299 788 | A | 10/1996 |
| JP | 5-193226 | | 8/1993 |
| JP | 07-314850 | | 12/1995 |

OTHER PUBLICATIONS

Otto B. Schwarz, Paul Grafstein; Pictorial Handbook of technical Devices 1971, Chemical Publishing Co., Inc., pp. 156–157.*

Patent Abstracts of Japan, vol. 017, No. 286 (M–1422), Jun. 2, 1993 & JP 05–016488 A (NEC Corp.) Jan. 26, 1993—Abstract.

Patent Abstracts of Japan, vol. 018 No. 602 (M–1705), Nov. 16, 1994 & JP 06–227086 A (OKI Electric Ind. Co., Ltd.)—Abstract.

Copy of Office Action (Decision of Dismissal of Amendment) dated Dec. 13, 2001 issued in a counterpart Korean application and English translation of said communication entitled Decision of Dismissal of Amendment.

Patent Abstracts of Japan, vol. 7, No. 265 (M–258), 1410, Nov. 25, 1983 and JP 58–145459 A (Ricoh K.K.), Aug. 30, 1983—Abstract.

* cited by examiner

*Primary Examiner*—John Barlow
*Assistant Examiner*—An H. Do
(74) *Attorney, Agent, or Firm*—Frishauf, Holtz, Goodman & Chick, P.C.

(57) ABSTRACT

A head loading device includes a print head for ejecting ink from a print position adjacent to a paper sheet to print an image with the ink, and an elevator for moving the print head upward from the print position at the time of non-printing and downward to the print position at the time of printing. The head loading device further includes a three-point support mechanism for supporting, at three points, the print head moved to the print position by the elevator to hold the print head at a preset distance from the paper sheet.

8 Claims, 3 Drawing Sheets

HEAD LOADING DEVICE

BACKGROUND OF THE INVENTION

The present invention relates to an ink-jet printer for printing an image with ink ejected from a print head and, more particularly, to a head loading device for moving the print head to a print position adjacent to a print medium in the ink-jet printer.

Serial ink-jet printers are conventionally widespread. In this serial ink-jet printer, the carriage is movably attached to a guide bar extending across the paper sheet, and the print head is mounted on this carriage together with a relatively-small-capacity ink cassette. This print head ejects ink supplied from the ink cassette while the carriage moves along the guide bar. Every time the carriage moves across the paper sheet, the paper sheet is fed at a predetermined pitch in a direction perpendicular to the guide bar. Since the print head moves together with the carriage at the time of printing, the print speed and ink supply amount cannot be increased owing to the carriage load and inertia. This ink-jet printer is therefore unsuitable for printing in large quantities at a high speed.

U.S. patent application Ser. No. 09/153,839 filed on Sept. 15, 1998 (now U.S. Pat. No. 6,126,267, issued on Oct. 3, 2000 to Ito et al), discloses a drum rotation type ink-jet printer. This ink-jet printer comprises a rotary drum which rotates in one direction, and a print head for printing an image on a paper sheet held by the rotary drum and rotating together with the rotary drum. The print head has a nozzle unit made up of a plurality of ink-jet nozzles aligned along the shaft of the rotary drum, and prints dots with ink ejected from these ink-jet nozzles. Since the print head does not move at the time of printing, the print speed and ink supply amount can be increased. In this case, ink is supplied to the print head from a large-capacity ink tank arranged in a free space apart from the print head. Thus, the ink-jet printer can print in large quantities at a high speed.

The ink-jet printer must perform a maintenance process for preventing clogging of the ink-jet nozzles or removing bubbles or sheet dust from the ink-jet nozzles periodically, e.g., every three hours. A typical rotary drum type ink-jet printer has a head loading mechanism for moving the print head relatively to the paper sheet. The head loading mechanism sets the print head to a print position where the ink-jet nozzle is apart from the rotary drum by only about 1 mm at the time of printing, and to a maintenance position where the ink-jet nozzle is more apart from the rotary drum than the print position at the time of non-printing. At the time of non-printing, a maintenance unit is inserted between the print head and rotary drum to perform the maintenance process using ink ejected from the ink-jet nozzle.

In the rotary drum type ink-jet printer, the print quality readily degrades due to a positional error generated when the print head returns from the maintenance position to the print position. To prevent this positional error, the head loading mechanism must be assembled at a high precision using high-quality components formed at a high precision. This inhibits the manufacture of a low-cost ink-jet printer. Even if the print head has been accurately set to the print position by the head loading mechanism, when the distance between the ink-jet nozzle and rotary drum fluctuates due to vibrations caused by the rotation of the motor or the like, the print quality degrades.

BRIEF SUMMARY OF THE INVENTION

It is an object of the present invention to provide a head loading device capable of accurately and stably setting the print head at the print position while reducing the manufacturing cost.

According to the present invention, there is provided a head loading device which comprises a print head for ejecting ink from a print position adjacent to a print medium to print an image with the ink, an elevator for moving the print head upward from the print position at the time of non-printing and downward to the print position at the time of printing, and a support mechanism for supporting, at least three points, the print head moved to the print position by the elevator to hold the print head at a preset distance from the print medium.

In this head loading device, the print head can be reliably supported by the support member instead of the elevator, when the print head has been moved to the print position after a maintenance process is performed at a position above the print position. The print head can be accurately and stably set at the print position without requiring high reliability of the elevator, which increases the manufacturing cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to an embodiment of the present invention will be described below with reference to the several views of the accompanying drawing.

Figure 1:
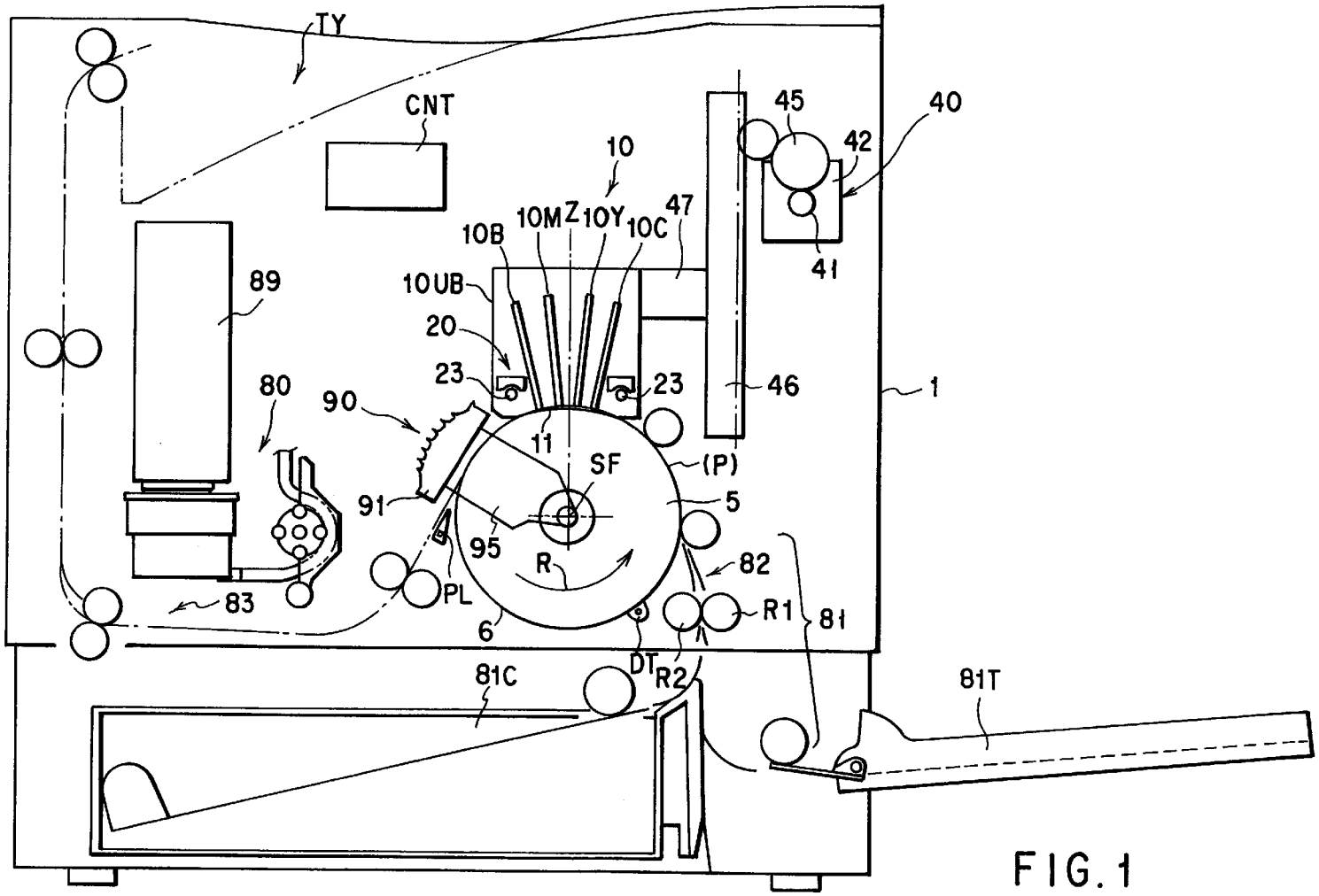
FIG. 1 is a view showing the internal structure of an ink-jet printer according to an embodiment of the present invention.

FIG. 1 shows the internal structure of the ink-jet printer. This ink-jet printer is used for multicolor printing on sheets of paper P serving as a print medium. This paper sheet P is a plain paper sheet or OHP sheet.

The ink-jet printer comprises a rotary drum 5 for rotating at a predetermined peripheral speed while holding the paper sheet P, a print head 10 for performing multicolor printing on the paper sheet P rotating together with the rotary drum 5, a manual feed tray 81T for receiving each of paper sheets P fed one by one, a sheet cassette 81C for storing a stack of paper sheets P placed therein, a sheet feed-in mechanism 81 for feeding each of paper sheets P from the sheet cassette 81C and manual feed tray 81T into the rotary drum 5, a sheet feed-out mechanism 83 for feeding out a printed paper sheet P held on the rotary drum 5, and a control unit CNT for controlling the whole operation of the ink-jet printer. As shown in FIG. 1, the rotary drum 5 is located near the central position in a housing 1, the manual feed tray 81T is located at a position lower than the rotary drum 5 and protrudes outward from the front surface of the housing 1, and the sheet cassette 81C is located below the rotary drum 5. The sheet feed-in mechanism 81 is interposed between the manual feed tray 81T and sheet cassette 81C. The print head 10 is set above the rotary drum 5. The sheet feed-out mechanism 83 is located at the rear side of the rotary drum 5 which is opposite to the sheet feed-in mechanism 81.

Figure 2:
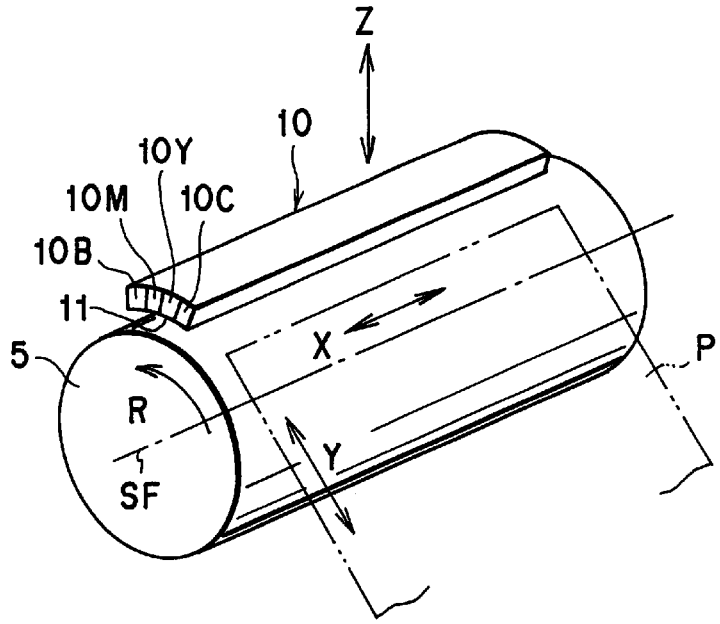
FIG. 2 is a perspective view showing the positional relationship between a print head and rotary drum shown in FIG. 1.

As shown in FIG. 2, the rotary drum 5 is supported rotatably about a shaft SF, and winds up and holds the paper sheet P on a peripheral surface 6 thereof. The rotational position of the rotary drum 5 is detected by a rotational position detector DT disposed at a position adjacent to the peripheral surface of the rotary drum 5. The print head 10 is constituted by four nozzle units 10C, 10Y, 10M, and 10B which are sequentially aligned from the upstream side to the downstream side along the peripheral surface 6 of the rotary drum 5 and perform printing on the paper sheet P with cyan, yellow, magenta, and-black inks, and a fixing frame 10UB for fixing these nozzle units 10C, 10Y, 10M, and 10B. The print head 10 receives the respective color inks from four ink supply units 80 separated from the print head 10. The nozzle units 10C, 10Y, 10M, and 10B have the same arrangement in which a plurality of ink-jet nozzles are aligned at a pitch PT of, e.g., 1/75 inch in an axial direction X of the rotary drum 5 and eject corresponding color inks to the paper sheet P. The distal ends of the ink-jet nozzles are flush with a distal end 11 of the print head 10. These ink-jet nozzles are aligned to have a span corresponding to 210 mm which is the width of an A4-size paper sheet P. The sheet feed-in mechanism 81 has a sheet loader 82 for loading the paper sheet P to the rotary drum 5 such that the width direction of the paper sheet P coincides with the axial direction X of the rotary drum 5. The sheet feed-in mechanism 81 takes up a paper sheet P from one of the manual feed tray 81T and sheet cassette 81C to feed it to the sheet loader 82. The sheet loader 82 is controlled to load the paper sheet P to the rotary drum 5 when the rotational position detector DT detects that the rotary drum 5 has rotated to a predetermined position. The print head 10 performs color printing on the paper sheet P along with the rotation of the rotary drum 5 holding the paper sheet P on the peripheral surface 6. The paper sheet P is separated from the peripheral surface 6 of the rotary drum 5 by a sheet separator PL after printing, and fed to a discharge tray TY by the sheet feed-out mechanism 83. The sheet separator PL is a separation claw which comes into contact with the rotary drum 5 at the time of sheet separation.

The print head 10 is capable of being slightly shifted forward and backward in a main scanning direction X parallel to the axial direction of the rotary drum 5. The rotary drum 5 holds the paper sheet P wound around the peripheral surface 6, and rotates to move the paper sheet P in a subscanning direction Y perpendicular to the main scanning direction X while facing the nozzle units 10C, 10Y, 10M, and 10B. The rotary drum 5 is kept at a predetermined revolutions of 120 rpm and makes one revolution every 0.5 sec in order to achieve, e.g., 20-PPM multicolor printing. In the printing operation, the print head 10 is shifted in the main scanning direction X at a constant rate of ¼ predetermined nozzle pitch PT per one revolution of the rotary drum 5, so as to move a distance equal to the nozzle pitch PT during four revolutions of the drum 5. In this arrangement, printing on the entire paper sheet P is completed within 2 sec (=0.5 sec×4) required for the four revolutions of the rotary drum 5. Even when the rotary drum 5 makes two revolutions in order to wind up the paper sheet P before the start of printing and in order to separate the paper sheet P after printing, multicolor printing can be performed on an A4-size paper sheet P at a high speed of 3 (=2+1) sec per sheet. This ink-jet printer can continuously print on 20 paper sheets per min.

The sheet loader 82 is made up of a pair of supply rollers R1 and R2 extending along the drum shaft, and is used to load the paper sheet P from each of the feeders 81T and 81C to the rotary drum 5 at a predetermined timing. The loading speed of the paper sheet P is set to correspond to the peripheral speed of the rotary drum 5.

In the ink-jet printer, a maintenance unit 90 can be inserted between the print head 10 and the rotary drum 5. The maintenance unit 90 has a washing board 91 faced to the distal end of the print head 10, for removing sheet dust attached to the distal end 11 with ink ejected from the ink-jet nozzles of the nozzle units 10C, 10Y, 10M, and 10B in order to prevent clogging of the ink-jet nozzles and remove bubbles generated from the ink-jet nozzles, and to collect this ink as waste ink.

This ink-jet printer further comprises an elevator 40 for elevating the print head 10. The elevator 40 includes a motor 42 fixed to the housing 1, a worm gear 41 attached to the rotating shaft of the motor 42, a worm wheel 45 engaging with the worm gear 41, and a rack member 46 threadably engaging with the worm wheel 45. The rack member 46 is coupled to the fixing frame 10UB of the print head 10 by a coupling member 47. The engagement of the worm gear 41 and wheel 45 allows elevating the rack member 46 along with the rotation of the motor 42 and prevents displacement of the rack member 46 coupled to the print head 10 and moved up and down by an external force. Thus, the vertical movement of the print head 10 due to vibrations or the like can be avoided.

Figure 3A:
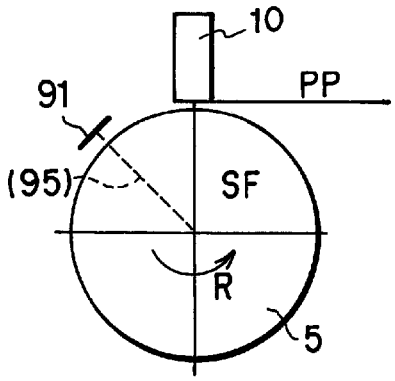
FIGS. 3A to 3D are views for explaining the motion of the print head shown in FIG. 1.
Figure 3B:
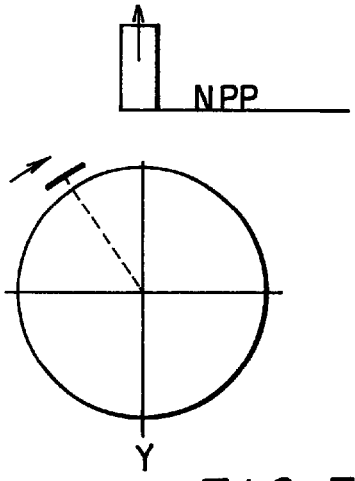
Figure 3C:
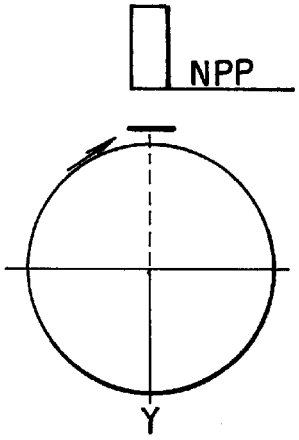

With the elevator 40, the print head 10 is set to a print position PP shown in FIG. 3A at the time of printing and to a standby position NPP shown in FIGS. 3B and 3C at the time of non-printing. At the time of maintenance, the print head 10 is set to a maintenance position MP shown in FIG. 3D in order to perform a maintenance process for the print head 10 while the print head 10 is kept unused for printing.

The washing board 91 can be moved pivotally about the shaft SF of the rotary drum 5 by a rotation mechanism 95, and can be selectively inserted or retracted between the print head 10 and the peripheral surface 6 of the rotary drum 5. That is, the washing board 91 is set to a retraction position where the washing board 91 inclines 45° to the left, as shown in FIG. 3A, when printing is performed, and moves from this retraction position to a washing position shown in FIGS. 3C and 3D when the maintenance process is performed.

The ink-jet printer further comprises a three-point support mechanism 20 which supports, at three points, the mounted print head 10 placed thereon by the elevator 40 at the print position PP to hold the distal ends of the nozzle units 10C, 10Y, 10M, and 10B of the print head 10 at a preset distance of, e.g., 1 mm from the paper sheet P.

Figure 4:
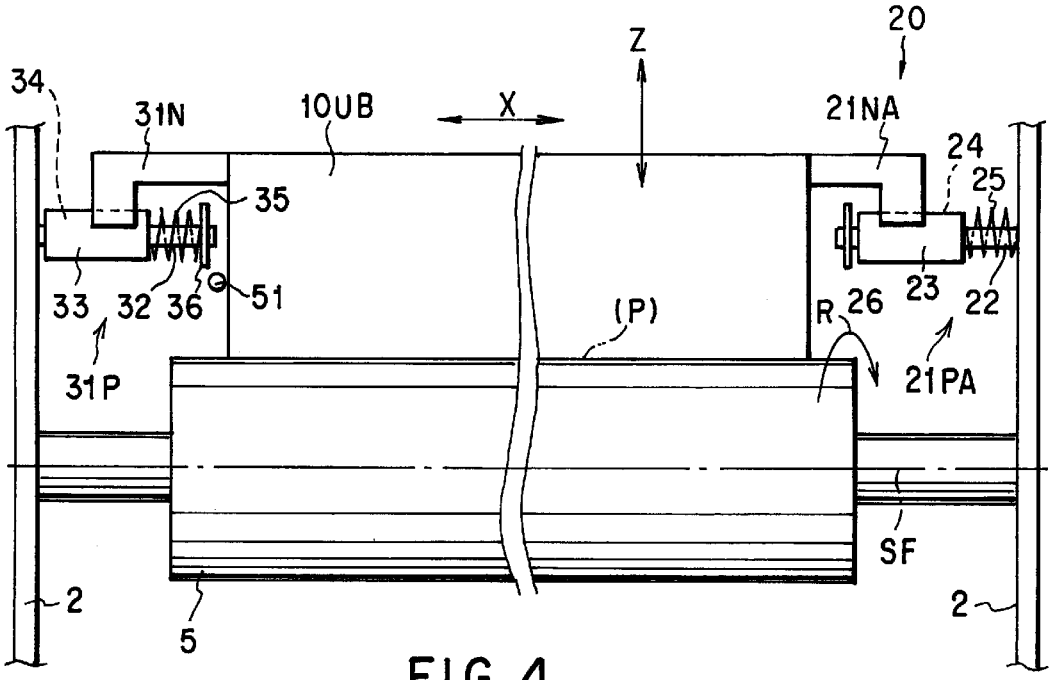
FIG. 4 is a side view showing a three-point support mechanism shown in FIG. 1.
Figure 5:
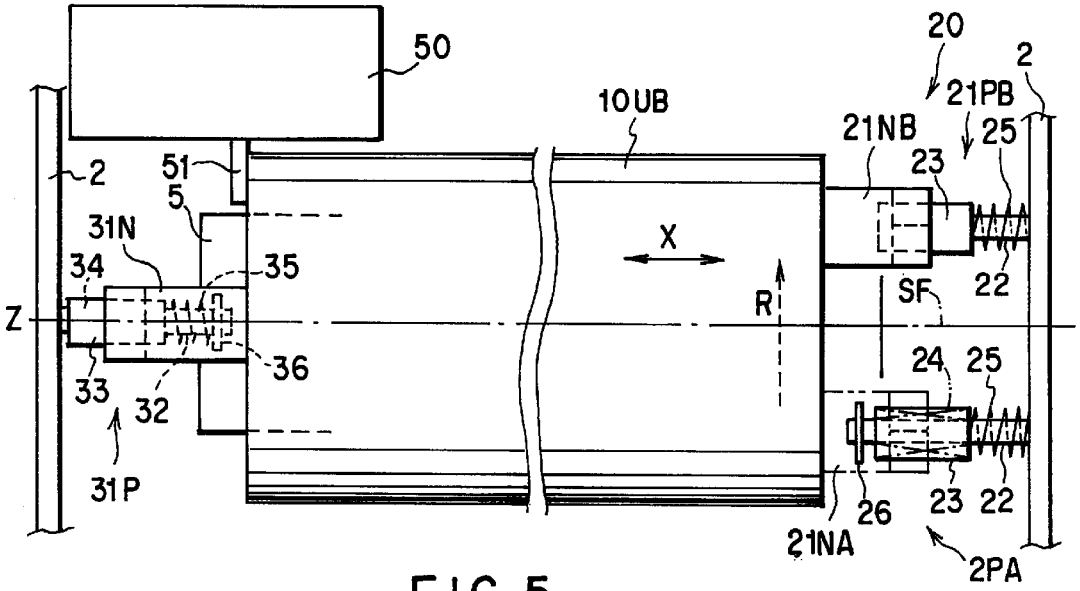
FIG. 5 is a top view showing the three-point support mechanism shown in FIG. 1.

As shown in FIGS. 4 and 5, the three-point support mechanism 20 is constituted by three engaging arms 21NA, 21NB, and 31N which horizontally project from the fixing frame 10UB of the print head 10 toward a pair of brackets 2 that are formed integrally with the housing 1 to be adjacent to the two sides of the rotary drum 5 and rotatably support the shaft of the rotary drum 5, and three arm supports 21PA, 21PB, and 31P which horizontally project from the brackets 2 toward the rotary drum 5 and respectively support the engaging arms 21NA, 21NB, and 31N.

The engaging arms 21NA, 21NB, and 31N have the same structure, and the arm supports 21PA, 21PB, and 31P also have the same structure. The arm supports 21PA and 21PB are disposed on one side of the rotary drum 5, and the arm support 31P is disposed on the other side of the rotary drum 5. The engaging arms 21NA and 21NB are disposed on one end of the rotary drum 5 so as to engage with the arm supports 21PA and 21PB, and the engaging arm 31N is disposed on the other end of the rotary drum 5 so as to engage with the arm support 31P. Each of the engaging arms 21NA and 21NB is made up of a hanger member having a V-shaped notch distal end and a proximal end fixed to the fixing frame 10UB. Each of the arm supports 21PA and 21PB is made up of a support shaft 22 fixed to the bracket 2, a cylindrical member 23 mounted on the support shaft 22 movably in the main scanning direction X via a bearing 24, and a spring 25 fitted on the support shaft 22, for urging the cylindrical member 23 to make a backward movement to the left in FIG. 4. A stopper 26 is fixed to the distal end of the support shaft 22 to regulate the position of the cylindrical member 23 moved backward in FIG. 4, i.e., to regulate the home position of the print head 10 in the main scanning direction X. If an external urging force for a forward movement to the right in FIG. 4 is applied from a driving pin 51 of a reciprocal unit 50 shown in FIG. 5, the print head 10 moves forward against the urging force of the spring 25. If the external urging force is removed, the print head 10 moves backward to the home position by the urging force of the spring 25. The forward movement distance of the print head 10, which coincide with that of the driving pin 51 moved in the main scanning direction X, is set to a pitch corresponding to a print resolution of, e.g., 300 dpi. Note that the ink-jet nozzles of the nozzle units 10C, 10Y, 10M, and 10B are aligned in the main scanning direction X at a pitch twice the print resolution of 300 dpi.

The engaging arm 31N also made up of a hanger member having a V-shaped notch distal end and a proximal end fixed to the fixing frame 10UB. The arm support 31P is made up of a support shaft 32 fixed to the bracket 2, a cylindrical member 33 mounted on the support shaft 32 movably in the main scanning direction X via a bearing 34, and a spring 35 fitted on the support shaft 32 for urging the cylindrical member 33 to make a backward movement-to the left in FIG. 4. The arm supports 21PA and 21PB can hold the engaging arms 21NA and 21NB to be flush with each other, as shown in FIG. 4. Also, the arm support 31P is attached to hold the engaging arm 31N to be flush with the engaging arms 21NA and 21NB held by the arm supports 21PA and 21PB. Accordingly, the relative positional relationship between the print head 10 and the peripheral surface 6 of the rotary drum 5 can be accurately set and stably maintained after the print head 10 has been moved to the print position PP.

Figure 3D:
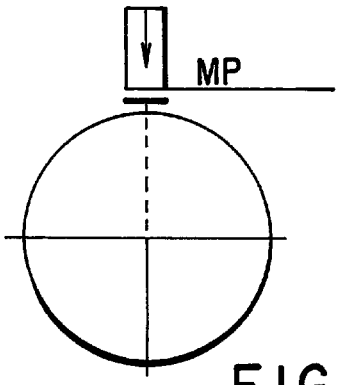

In the ink-jet printer in this embodiment, the elevator 40 moves the print head 10 upward to the standby position NPP shown in FIGS. 3C and 3B upon completion of maintenance for the nozzle units 10C to 10B performed at the maintenance position MP shown in FIG. 3D. At this time, the rotation mechanism 95 operates to return the washing board 91 of the maintenance unit 90 to the retraction position shown in FIG. 3A. The elevator 40 operates to move the print head 10 downward from the standby position NPP shown in FIG. 3B toward the print position PP. The three-point support mechanism 20 defines the positional relationship between the print head 10 and peripheral surface 6 in the axial direction Z. Since the print head 10 is kept at the print position PP above the peripheral surface 6 with a predetermined posture by the three-point support mechanism 20, the gap between the print head 10 and peripheral surface 6 can be quickly accurately set to a preset value of, e.g., 1 mm. In addition, since the print position PP is lower than the standby position NPP, the arm supports 21PA, 21PB, and 31P can support the engaging arms 21NA, 21NB, and 31N of the print head 10 using gravity to stably maintain the gap between the print head 10 and the peripheral surface 6.

Further, since the three-point support mechanism 20 can retain the three-dimensional posture of the print head 10 relative to the peripheral surface 6, the position of the print head 10 is stabilized not only in the axial direction Z perpendicular to the peripheral surface 6 but also in the main scanning direction X. The manufacturing cost can be reduced by a use of the three-point support mechanism 20, in which no complicated structure is required to quickly and accurately provide a desired gap between the print head 10 and peripheral surface 6 and reliably and stably maintain this gap. In addition, the manufacturing cost can be reduced much more because of the same structure employed for the engaging arm 21NA and arm support 21PA, the engaging arm 21NB and arm support 21PB, and the engaging arm 31N and arm support 31P of the three-point support mechanism 20 which are arranged to have a preset positional relationship therebetween.

Each pair of engaging arm and arm support is formed to support the print head 10 movably in the main scanning direction X, so that the nozzle units 10C to 10B of the print head 10 is moved right in FIG. 4 in the main scanning direction X by an external urging force applied from the reciprocal unit 50. The gap between the print head 10 and the peripheral surface 6 is maintained when positional. shifting of the print head 10 is permitted in the main scanning direction X. Therefore, an image can be printed with high resolution.

The arm supports 21PA and 21PB have a bearing structure using the support shaft 22, cylindrical member 23, and bearing 24, whereas the arm support 31P has a bearing structure using the support shaft 32, cylindrical member 33, and bearing 34. These structures can greatly reduce the resistance against relative displacement of the engaging arms 21NA, 21NB, and 31N in the main scanning direction X. Thus, it is possible to more smoothing the reciprocal movement of the print head 10 while decreasing the size and the power consumption of the print head 10.

The above bearing structures further comprise the springs 25 and 35 in order to return the print head 10 to the home position in the main scanning direction X when an external urging force is removed. Thus, the print speed can be enhanced according to reduction in the time required for reciprocating the print head 10.

The elevator 40 is formed such that the print head is elevated in the axial direction Z perpendicular to the peripheral surface 6 by the engagement of the worm gear 41 on the housing 1 side and the worm wheel 45 on the print head 10 side. The print head 10 can be held without any displacement caused by an upward external force acting in a direction opposite to the direction of gravity exerted on the print head 10. Accordingly, the relative position of the print head 10 with respect to the peripheral surface 6 can be more stably maintained.

Moreover, since the rotary drum 5 rotates together with the paper sheet P wound on the peripheral surface 6, the rotary drum 5 can feed the paper sheet P at a high speed in the subscanning direction Y perpendicular to the main scanning direction X. A higher printing speed can be attained by increasing the rotational speed of the rotary drum 5.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a print head which ejects ink toward a print medium to print an image with the ink;

a support mechanism which supports said print head at a print position where a preset distance is provided as a gap between said print head and said print medium; and an elevator which moves said print head upward at a time of non-printing and downward at a time of printing;

wherein said support mechanism includes an arm member horizontally projecting from said print head and a supporting member which is fixed to a housing and brought into contact with said arm member to restrict downward movement of said print head.

2. An ink-jet printer according to claim 1, wherein:

said print medium is held by a peripheral surface of a rotary drum rotatably attached at two ends to a pair of brackets that are integral with said housing;

said print head includes a plurality of ink-jet nozzles aligned in an axial direction of said rotary drum to eject the ink toward the print medium, and a fixing frame which fixes said ink-jet nozzles;

said arm member has a plurality of engaging arms horizontally projecting on both sides of said fixing frame in the axial direction of said rotary drum; and said supporting mechanism further includes arm supports horizontally projecting from said pair of brackets to engage with said engaging arms when said print head is moved downward by said elevator.

3. An ink-jet printer according to claim 2, wherein said engaging arms and said arm supports are formed such that said print head is movable relative to said peripheral surface of said rotary drum in the axial direction of said rotary drum upon application of an external urging force.

4. An ink-jet printer according to claim 3, wherein said arm supports comprise a bearing structure that accepts relative displacement of said engaging arms in the axial direction of said rotary drum.

5. An ink-jet printer according to claim 4, wherein said arm supports further comprise an urging member that urges said print head to return to a home position in the axial direction of said rotary drum upon removal of the external urging force.

6. An ink-jet printer according to claim 1, wherein said elevator comprises a worm gear adapted to be driven by a driving unit, and a worm wheel engaging with said worm gear to elevate said print head.

7. An ink-jet printer according to claim 6, wherein said driving unit is fixed to the housing, and the housing is integral with a pair of brackets to which a rotary drum is attached.

8. An ink-jet printer according to claim 1, wherein said support mechanism supports- at least three points of said print head.

* * * * *